United States Patent [19]

Krause

[11] Patent Number: 4,757,285

[45] Date of Patent: Jul. 12, 1988

[54] FILTER FOR SHORT ELECTROMAGNETIC WAVES FORMED AS A COMB LINE OR INTERDIGITAL LINE FILTERS

[75] Inventor: Heinz Krause, Emmering, Fed. Rep. of Germany

[73] Assignee: Siemens Aktiengesellschaft, Berlin and Munich, Fed. Rep. of Germany

[21] Appl. No.: 69,169

[22] Filed: Jul. 2, 1987

[30] Foreign Application Priority Data

Jul. 29, 1986 [DE] Fed. Rep. of Germany ..... 3625559

[51] Int. Cl.[4] ..... H01P 1/205; H01P 7/00

[52] U.S. Cl. ..... 333/203; 333/202; 333/219; 333/235

[58] Field of Search ..... 333/167, 168, 177, 179, 333/184, 185, 203, 202, 219, 204, 205, 222, 224, 208–212, 235; 336/232

[56] References Cited

U.S. PATENT DOCUMENTS

| | | | |
|---|---|---|---|
| 2,751,558 | 6/1956 | Grieg | 333/204 |
| 3,210,697 | 10/1966 | Comstock | 333/246 |
| 3,836,881 | 9/1974 | Koizumi | 336/87 |
| 3,864,824 | 2/1975 | Watson et al. | 333/185 |
| 3,895,325 | 7/1975 | Fischer et al. | 333/185 |
| 4,468,644 | 8/1984 | Teague et al. | 333/205 |

FOREIGN PATENT DOCUMENTS

| | | |
|---|---|---|
| 0044941 | 6/1981 | Fed. Rep. of Germany . |
| 1246658 | 10/1960 | France . |
| 770166 | 3/1957 | United Kingdom . |

OTHER PUBLICATIONS

7th European Microwave Conference—Conference Proceedings, published by Microwave Exhibitions and Publishers Inc., pp. 450–454, Monday 5 to Thursday 8, Sep. 1987.

Proceedings of the IEEE, Jan. 1979, vol. 67, No. 1, published by The Institute of Electrical and Electronics Engineers—Miniaturization of Wide-Band VHF Filters by Using Spiral Resonators—Inui and Nagai; pp. 20–24.

Spiral Resonator for PCM-400 M System—Nishi, Yanagisawa and Toshima, vol. 24, Nos. 9–10, Sep., Oct., 1976; pp. 776–786, Review of the Electrical Communication Laboratories.

The Design of Filters Using Helical Resonators in the VHF Band, by B. K. Dube, J. Instn. Electronics Telecom. Expos Vol. 22, 1976, No. 2PP77–79, 1976.

Band-Passand Band-Stop Microwave Filter Using λ/4 Circular Cylindrical Rod Resonators, by Yukio Ito, Takeshi Meguro, Dec. 1968, vol. 4, No. 3, Fujitsu Scientific and Technical Journal, p. 2853.

Patent Abstracts of Japan, Unexamined Application, E. Field, Nov. 2, 1983, The Patent Office Government, vol. 7, No. 247 (E-208 1392 58-133088/58 136255).

Patents Abstracts of Japan, Unexamined Applications, Aug. 11, 1977, E Section—The Patent Office, Japanese Government, vol. 1, No. 86; pp. 233–236.

*Primary Examiner*—Marvin L. Nussbaum

*Attorney, Agent, or Firm*—Hill, Van Santen, Steadman & Simpson

[57] ABSTRACT

Microwave filters which have the best electrical characteristics for small volumes are required in radio communications particularly in traffic broadcast communication links and the invention provides filters formed as comb line or interdigital line filters in which the inner resonator conductors are formed as flat spirals.

16 Claims, 4 Drawing Sheets

FILTER FOR SHORT ELECTROMAGNETIC WAVES FORMED AS A COMB LINE OR INTERDIGITAL LINE FILTERS

BACKGROUND OF THE INVENTION

1. Field of the Invention

The invention is directed to a filter such as a comb line or an interdigital line filter which uses flat spiral resonators.

2. Description of the Prior Art

The article entitled "Band-Pass and Band-Stop Microwave Filters Using λ/4 Circular Cylindrical Real Resonators" appearing in the Fujitsu Scientific Technical Journal, Vol. 4, No. 3, Pages 29 through 52 by Juhio Ito and Takeshi Meguro describes line filters. For mobile radio directional links and satellite links, transmission/reception diplexers and IF band-pass filters having high selectivity and low losses are required.

In addition to the demand for high resonator quality, small volme, low weight and cheap manufacturing costs for mass production are required in mobile radio such as, for example, for automobile telephones.

Until this time, filters were constructed using helix resonators as described in the publication by B. K. Dube, "The Design of Filters Using Helical Resonators in VHF-Band" appearing in the Journal of Institute of Electronics Telecom. Engineers, Vol. 22, No. 2 1976, pages 77 through 79. Alternatively, such filters were constructed using resonators in the form of metal rods for example, as comb or interdigital filters as disclosed in the Journal of Institute Electronics Telecom Engineers referenced above wherein ceramics such as described in U.S. Pat. No. 4,431,977 is used as the dielectric in addition to air thus reducing the length of the metal rod and the volume by the factor of $\sqrt{\epsilon}$ where $\epsilon$ is the dielectric constant of the ceramic.

Filters are also known in which planar spiral coils on a ceramic substrate are combined with discrete capacitors to form series circuits and are interconnected to form a band-pass filter. Neither high resonator quality nor low cost manufacturing are achieved with such technique.

Helix-shaped filters have relatively high manufacturing costs and many individual parts. The filters constructed with metal rods which use air dielectric are bulky and those having a ceramic dielectric are relatively heavy which is undesirable particularly in mobile devices.

SUMMARY OF THE INVENTION

It is an object of the present invention to provide a feasible filter fashioned as a comb line or interdigital line filter which has high quality electrical properties and which is small and can be cheaply manufactured.

It is a feature of the invention to provide a filter for short electromagnetic waves in the form of comb line or interdigital line filters wherein the resonators are arranged such their coupling provide line coupling and the inner conductors of the resonators are fashioned as planar spirals.

Other objects, features and advantages of the invention will become apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1A:
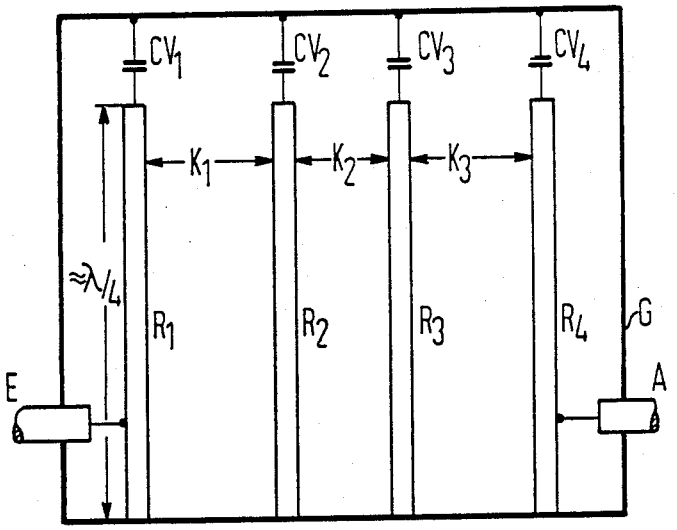
FIG. 1*a* is a plan view of a known filter formed as a comb line filter.
Figure 1B:
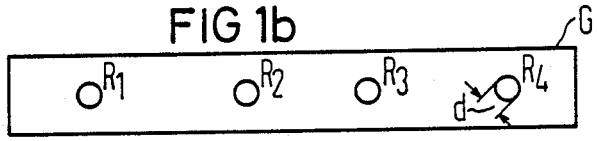
FIG. 1*b* is an elevational view of the filter of FIG. 1*a;*

FIGS. 1*a* and 1*b* illustrate the prior art described, for example, in the article quoted above "Fujitsu Sicentific Technical Journal" Vol. 4, No. 3, Pages 29–52. These Figures illustrate a comb line filter which has the same effect as interdigital filters. In the comb line filter, the inner conductors are arranged in the manner of a comb and enter at the same face of the housing whereas in an interdigital filter, the inner conductors alternately enter at opposite housing faces. In FIGS. 1*a* and 1*b*, four resonators R1, R2, R3 and R4 extend into the housing and they have a length of approximately λ/4. The capacitances $CV_1$, $CV_2$, $CV_3$ and $CV_4$ are between the inner ends of the resonators R1 through R4 and the wall of the housing. These capacitances may be actually connected real capacitances or they can also symbolically represent the stray capacitances of the four inner conductors R1 through R4. The diameter of the resonators R1 through R4 is d. An input line E generally is formed as a coaxial line and enters the wall of the housing and has its center conductor electrically attached to the resonator R1 intermediate its ends and the outer conductor is rigidly connected to the housing G. An output line A also comprises a coaxial line and has its outer conductor connected to the wall of the housing G and its conductor connected to the resonator R4. The coupling between the resonators comprise the couplings K1 between the resonators R1 and R2, the coupling K2 between the resonators R2 and R3 and the coupling K3 is the coupling between the resonators R3 and R4.

This prior art type of filter has disadvantages in that it requires a large amount of space and is also relatively heavy.

A first embodiment of the invention is illustrated in FIGS. *2a, 2b* and *2c* wherein planar spiral resonators $SpR_1$, $SpR_2$, $SpR_3$ and $SpR_4$ are mounted in a housing G and the spiral resonators are formed as flat planar helixes or spirals. A line coupling K1 exists between the resonators $SpR_1$ and $SpR_2$ and a line coupling K2 exists between the resonator $SpR_2$ and resonator $SpR_3$. Also, line coupling K3 exists between the spiral resonator $SpR_3$ and $SpR_4$ as illustrated.

As illustrated in FIGS. *2b* and *2c*, tuning screws $A_1$, $A_2$, $A_3$ and $A_4$ are mounted in the wall of the housing G and extend respectively in toward the spiral resonators $SpR_1$ through $SpR_4$. The tuning screws extend perpendicular to the planes of the spiral resonators and the longitudinal axes of the tuning screws is aligned approximately with the center of the spiral resonators as illustrated.

Figure 3:
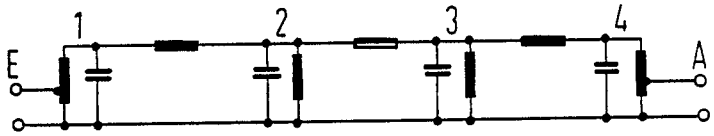
FIG. 3 is a simplified equivalent circuit diagram of the filter of FIG. 2*a* comprising four resonant circuits.

FIG. 3 is an equivalent circuit diagram of the filter illustrated in FIGS. *2a, 2b* and *2c*. The equivalent circuit has four resonant circuits 1, 2, 3 and 4. The input E and the output A are illustrated as tapped coils to symbolically represent the transformation effect of the tapping illustrated in FIG. *2a* and *2b*.

The significant advantage of the plane resonators is that the full resonator set of a filter can be manufactured in a precise and inexpensive manner by punching, shaped etching or casting technology as well on laminated printed circuit boards which is impossible with the helix resonators of the prior art since they are not planar structures. So as to design the invention, the design methods for line filters such as discussed in the article Fujitsu Scientific Technical Journal, Vol. 4, No. 3, Pages 29–52 can be utilized in which the coupling distances K1, K2 and K3 between the helixes is dependent on the selected helix-shape and the direction of the turns and must be experimentally determined. A slight shortening of the length of the helix as compared to an elongated resonator is required because of the additional capacitance $C_w$ occurring between the helix windings.

FIGS. *2a, 2b* and *2c* thus illustrate an untuned filter mounted between the input E and the output A comprising etched or punched or spark erroded compact resonators $SpR_1$, $SpR_2$, $SpiR_3$ and $SpR_4$ integrated in a housing and surrounded by a dielectric D1 which, for example, is air. Frequency tuning is possible using the screws A1, A2, A3 and A4. FIG. 3 is a simplified equivalent circuit having four resonant circuits.

Another embodiment of the invention is illustrated in FIGS. *4a, 4b* and *4c* including spiral resonators $SpR_1$, $SpR_2$, $SpR_3$ and $SpR_4$ having overall coupling $\ddot{U}_1$ and $\ddot{U}_2$. FIGS. *5a* and *5b* also illustrate a spiral-shaped resonator filter. FIG. 6 is the electrical equivalent circuit of the filters of FIGS. 4 and 5. The overall coupling $\ddot{U}_1$ is from the input E to a connecting point $S_1$ and the overcoupling $\ddot{U}_2$ extends from a connecting point $S_2$ to the output A. When such overcouplings do not lead directly from the input to the first resonator $SpR_1$ or, respectively, an overcoupling $\ddot{U}_2$ does not lead directly to the output A then as is known attenuation poles in the filter characteristics can be produced.

Figure 5A:
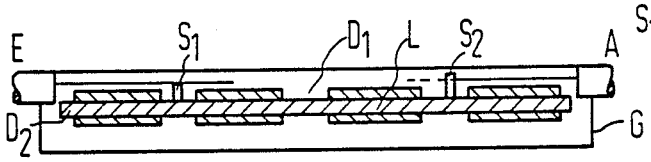
FIG. 5*a* is a top elevational view of a spiral filter resonator comprising four planar resonators on a double laminated printed circuit board L.
Figure 5B:
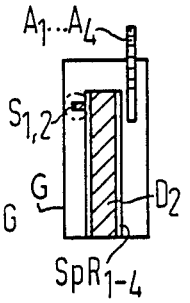
FIG. 5*b* is a side elevation of the filter of FIG. 5*a;*
Figure 6:
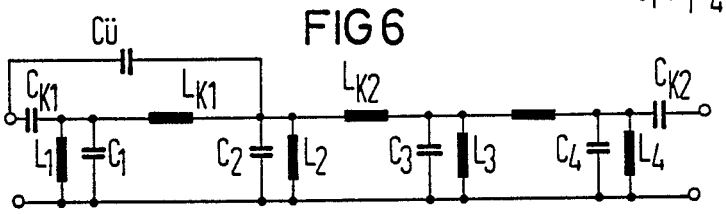
FIG. 6 is a simplified electrical equivalent circuit diagram of the filters of FIGS. 4*a* and 5*a;*

In detail, two resonator sets $SpR_1$ through $SpR_4$ are connected in parallel in the exemplary embodiment of FIG. 5. The two resonator sets have the same geommetry and the parallel connection of the individual conductors lowers the losses and, thus, increases the quality characteristics of the filters. The resonator sets in FIG. 5 are mounted on opposite sides of a planar plate $D_2$ as illustrated.

Figure 4A:
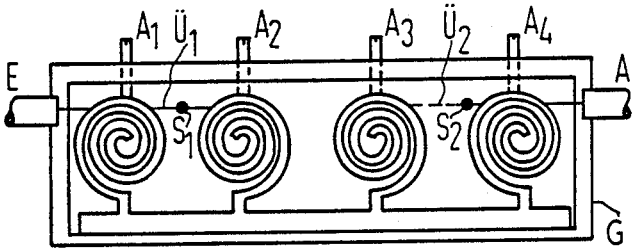
FIG. 4*a* is a top plan view of a spiral resonator filter comprising four planar resonators on a carrier plate T having an overcoupler U.
Figure 4C:
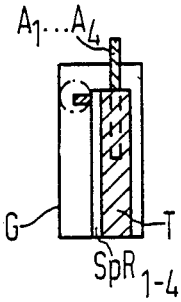
FIG. 4*c* is an end sectional view of the filter of FIG. 4*a;*
Figure 4B:
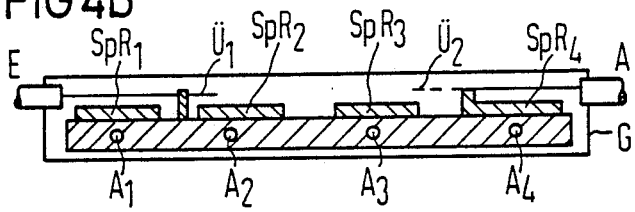
FIG. 4*b* is a top sectional view of the filter of FIG. 4*a;*

FIG. 6 is a schematic showing the equivalent circuit of the filters of FIGS. 4 and 5 and the associated inductances are indicated by the inductances $L_1$ through $L_2$ and the associated capacitances are indicated by the capacitors $C_1$ through $C_4$. The input coupling capacitance is identified as $C_{K1}$ and the output coupling capacitance is identified $C_{K2}$. Inductances in the series arms of the circuit lie between individual resonator circuits and these are respectively identified as $L_{K1}$ and $L_{K2}$. A capacitive overcoupling $C_u$ which is connected from the input to the resonant circuit 2 represents the effect of the overcoupling $\ddot{U}_1$.

Figure 2A:
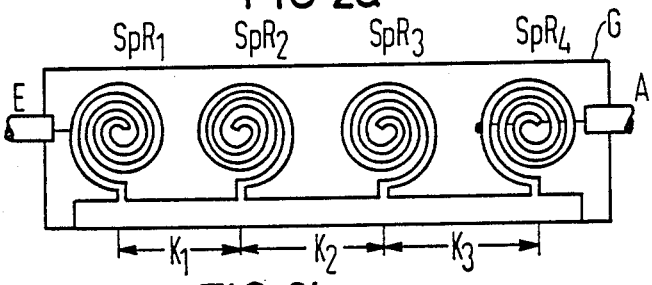
FIG. 2*a* illustrates a spiral resonator filter using four planar resonators.
Figure 2B:
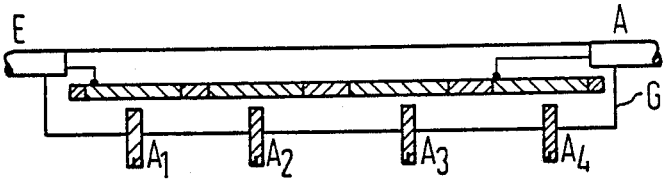
FIG. 2*b* illustrates a top elevational view of the filter of FIG. 2*a;*
Figure 2C:
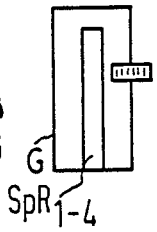
FIG. 2*c* is a side elevational view of the filter of FIG. 2*a;*

In the exemplary embodiment of FIG. 2, the complete resonator set was incorporated into the housing G and additionally secured in planar form on a low loss carrier plate, for example, a teflon carrier plate T so as to avoid mechanical vibrations. Holes for the tuning elements A1 through A4 and the coupling terminals $S_1$ and $S_2$ are also attached to the carrier plate T as shown.

As an example, the resonator set of FIGS. *5a* and *5b* has been constructed on a double laminated low loss printed circuit board L. Depending on the type of dielectric employed, a lower quality is to be expected than the use of air dielectric. Equivalent circuit diagram for the devices of FIGS. 4 and 5 are shown in FIG. 6. Other advantages can be obtained from the invention. A finite pole location which is realized by the overcoupling $C_u$ illustrated in FIG. 6 or, respectively, $\ddot{U}_1$ may be observed from the characteristic function $$\phi(p) = K \frac{(p^2 + a^2) \prod_{v=1}^{4} (p^2 + \Omega_{ov}^2)}{p^3(p^2 + \Omega_\infty{}^2)}$$

which defines the circuit of FIG. 6.

A further pole location would be possible for example, due to the overcoupling $\ddot{U}_2$ from $SpR_4$ to $SpR_3$ illustrated in FIG. 4. So as to design filters of $\lambda/4$ wavelength resonators, the design parameters for air dielectric filters can be utilized.

Including the effect of an attenuating factor, the line length of the spirals of the resonators is equal to $\lambda/4$. The frequency corresponding to this wavelength is the middle of the pass band.

The characteristic impedance Z is selected between 50 and 150. With rectangular cross-section of the conductor, Z is known to be dependent on the conductor width and thicknesses as well as on the spacing from the metal housing and can be calculated with known methods as in strip-line technology.

The resonant qualities are essentially dependent on the nature and conductivity of the surface and on the volume of the filter. Two resonator arrangements of identical geommetry such as shown in FIG. 5 constructed parallel at roughly the spacing of the conductor width produces quality improvements up to 30%.

Figure 7:
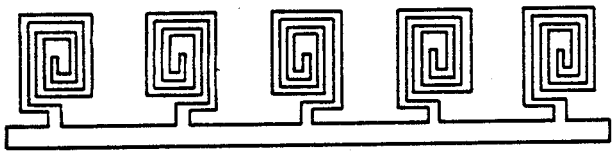
FIG. 7 is a top planar view of a five circuit spiral resonator arrangement wherein the spirals are formed generally rectangular-shaped.
Figure 8A:
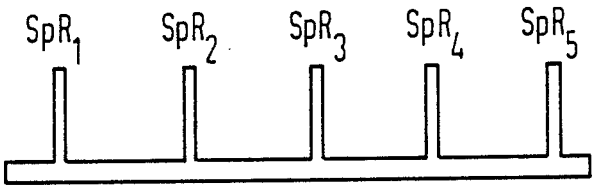
FIG. 8*a* is a top elevational view of a five circuit spiral resonator filters wherein the resonators are rotated 90° relative to the FIGS. 2–7.
Figure 8B:
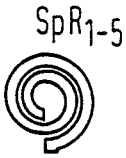
FIG. 8*b* is a side elevational view of the filter of FIG. 8*a;*
Figure 9A:
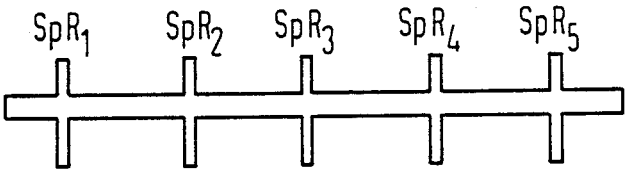
FIG. 9*a* is a plan view of a five circuit spiral resonator filter having individual resonators rotated by 90° having an internal grounding M of the spirals.
Figure 9B:
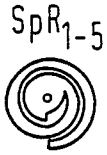
FIG. 9*b* is a side elevational view of the filter of FIG. 9*a;*
Figure 10A:
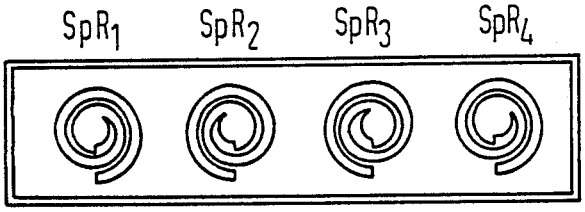
FIG. 10*a* is a plan view of a four circuit spiral resonator arrangement comprising planar individual resonators and inner grounding of the individual resonators.
Figure 10B:
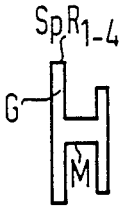
FIG. 10*b* is an end view of the resonator of FIG. 10*a;*.

FIGS. 7–10 illustrate other modifications of the invention and they are shown schematically in these views. For example, a geommetry of the resonators need not be limited to spirals having a constant path. The resonators can also be realized in rectangular form as illustrated in FIG. 7 or different line cross-sections can be utilized which are adapted to the current utilization of the resonator. Also, the spirals can be rotated 90° such that the resonators $SpR_1$ through $SpR_4$ can be accomplished as illustrated in FIGS. *8a, 8b, 9a* and *9b*. The centers M of the spirals can also be selected as shared low ends of the spirals as shown in FIGS. *9a* and *10a*. In the example of FIG. *10a* and *10b*, a carrier plate G to allow connections M to ground and to the resonators $SpR_1$ through $SpR_4$ is utilized.

Figure 11:
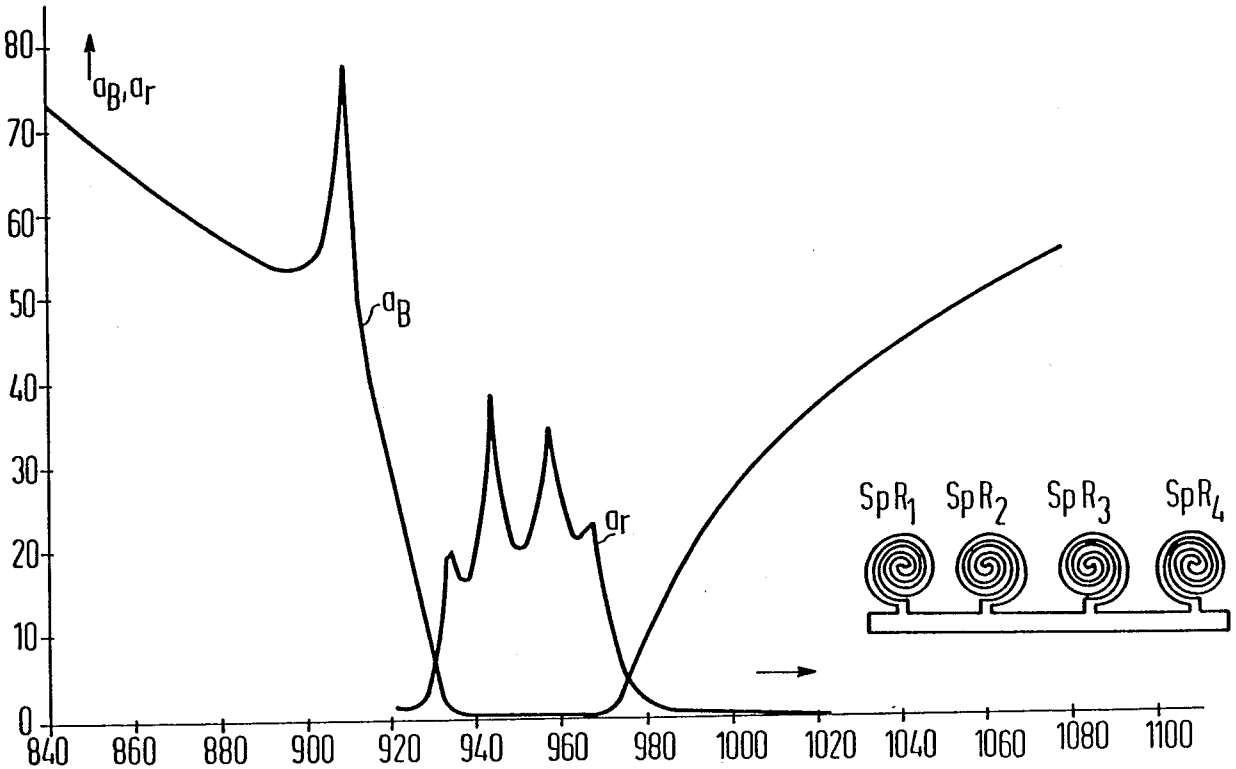
FIG. 11 are characteristic curves showing the operating attenuation of $a_B$ and the reflection attenuation $a_R$ of a four circuit filter such as shown in FIGS. 4*a*, 4*b* and 4*c* as a function of the frequency f.

FIG. 11 is a plot of the measured curve of the operating attenuation $a_B$ and the reflection attenuation $a_r$ depending on the frequency f of a filter of FIG. 4 constructed for 900 Mhz. The pass-band is roughly between 935 MHz and 970 MHz. An attenuation pole of the operating attenuation $a_B$ occurs in the lower frequency stop band, in other words, at about 910 MHz so it can be seen that steepening of the operating attenuation curve is possible as desired.

Another advantage of the filters is that they require relatively small volume and have good electrical properties particularly in the frequency range of traffic broadcasting also. The resonators formed as spiral resonators result in a shortening of the electrical structure length and this is advantageous since it results in smaller devices which is particularly advantageous for mobile systems.

Although the invention has been described with respect to preferred embodiments, it is not to be so limited as changes and modifications can be made which are within the full intended scope of the invention as defined by the appended claims.

I claim as my invention:

1. A comb line filter for short electromagnetic waves comprising, a housing (G), an output coupling lead (A) and an input coupling lead (E) connected to opposite sides of said housing, a plurality of spiral shaped resonators ($SpR_1$, $SpR_2$, $SpR_3$, $SpR_4$) mounted in said housing, a plurality of line coupling means ($K_1$, $K_2$, $K_3$) mounted in said housing and said resonators and said line couplings alternately, connected in series between said input coupling lead (E) and said output coupling lead (A) and wherein the shape and size of said housing is such that characteristic impedance Z of said filter is in the range of 50 to 150 ohms.

2. A filter according to claim 1, including tuning elements ($A_1 \ldots A_4$) are mounted to said housing and positioned so that at least one tuning element extends into the field space of one of said spiral resonators ($SpR_1 \ldots SpR_4$).

3. A filter according to claim 2, wherein said tuning elements ($A_1 \ldots A_4$) are formed as tuning screws whose longitudinal axis are perpendicularly to the plane of said spiral resonators ($SpR_1 \ldots SpR_4$) and said screws extend toward the centers of said spiral resonators.

4. A filter accoridng to claim 1 wherein the shape of said spiral resonators ($SpR_1$) deviate from a constant pitch spiral.

5. A filter according to claim 4 wherein said spiral resonators (SpR) are rectangularly shaped.

6. A filter according to claim 1 wherein the conductor cross-section of said spiral resonators (SpR) change steadily or discontinuously.

7. A filter according to claim 1 wherein said spiral resonators ($SpR_1 \ldots SpR_4$) are mounted such that the planes formed by the spiral resonators lie in the same plane.

8. A filter according to claim 1 wherein said spiral resonators ($SpR_1 \ldots SpR_5$) are mounted such that the planes formed by said spiral resonators are parallel to each other.

9. An interdigital line filter for short electromagnetic waves comprising, a housing (G), an output coupling lead (A) and an input coupling lead (E) connected to opposite sides of said housing, a plurality of spiral shaped resonators ($SpR_1$, $SpR_2$, $SpR_3$, $SpR_4$) mounted in said housing, a plurality of line coupling means ($K_1$, $K_2$, $K_3$) mounted in said housing and said resonators and said line couplings, alternately, connected in series between said input coupling lead (E) and said output coupling lead (A) and wherein the shape and size of said housing is such that characteristic impedance Z of said filter is in the range of 50 to 150 ohms.

10. A filter according to claim 9, including tuning elements ($A_1 \ldots A_4$) are mounted to said housing and positioned so that at least one tuning element extends into the field space of one of said spiral resonators ($SpR_1 \ldots SpR_4$).

11. A filter according to claim 10, wherein said tuning elements ($A_1 \ldots A_4$) are formed as tuning screws whose longitudinal axis are perpendicularly to the plane of said spiral resonators ($SpR_1 \ldots SpR_4$) and said screws extend toward the centers of said spiral resonators.

12. A filter according to claim 9 wherein the shape of said spiral resonators ($SpR_1$) deviate from a constant pitch spiral.

13. A filter according to claim 12 wherein said spiral resonators (SpR) are rectangularly shaped.

14. A filter according to claim 9 wherein the conductor cross-section of said spiral resonators (SpR) change steadily or discontinuously.

15. A filter according to claim 9 wherein said spiral resonators ($SpR_1 \ldots SpR_4$) are mounted such that the planes formed by the spiral resonators lie in the same plane.

16. A filter according to claim 9 wherein said spiral resonators ($SpR_1 \ldots SpR_5$) are mounted such that the planes formed by said spiral resonators are parallel to each other.

* * * * *